United States Patent [19]

Lindberg

[11] Patent Number: 4,587,770

[45] Date of Patent: May 13, 1986

[54] BELT SANDER ATTACHMENT FOR A PORTABLE DRILL

[76] Inventor: Robert C. Lindberg, Rte. 2, Box 306R, Dorchester, Wis. 54425

[21] Appl. No.: 616,561

[22] Filed: May 31, 1984

[51] Int. Cl.[4] ..... B24B 23/06; B24B 21/02

[52] U.S. Cl. ..... 51/170 EB; 51/135 BT

[58] Field of Search ..... 51/170 EB, 170 R, 135 R, 51/135 BT, 148

[56] References Cited

U.S. PATENT DOCUMENTS

| | | | |
|---|---|---|---|
| 2,106,535 | 1/1938 | Pattison et al. | 51/170 EB |
| 2,483,720 | 10/1949 | Asbury | 51/135 |
| 2,486,255 | 10/1949 | Briskin | 51/170 EB |
| 2,538,044 | 1/1951 | Ruehle | 51/148 |
| 2,556,041 | 6/1951 | Pick | 51/170 EB |
| 2,819,565 | 1/1958 | Werth | 51/170 EB |
| 2,976,652 | 3/1961 | Bedortha et al. | 51/170 EB |
| 3,009,297 | 11/1961 | Westerfield | 51/170 EB |
| 3,073,083 | 1/1963 | Reichert | 51/170 EB |
| 3,091,061 | 5/1963 | Bahr | 51/170 EB |
| 3,465,479 | 9/1969 | Foody et al. | 51/170 EB |
| 3,497,336 | 2/1970 | Buschman | 51/170 EB |
| 3,566,549 | 3/1971 | Britton | 51/170 EB |
| 3,983,664 | 8/1976 | Martin | 51/170 EB |
| 4,043,083 | 8/1977 | Rosdil | 51/170 EB |
| 4,118,897 | 10/1978 | Martin | 51/170 EB |
| 4,317,282 | 3/1982 | Pace | 51/170 EB |
| 4,334,390 | 6/1982 | Sumerau | 51/170 EB |

*Primary Examiner*—Roscoe V. Parker

*Attorney, Agent, or Firm*—Andrus, Sceales, Starke & Sawall

[57] ABSTRACT

A belt sander attachment (2) is disclosed for a portable drill or the like (4), for sanding curved or flat surfaces. A frame (6) has a drive roller (8) and an idle roller (10) mounted thereto together with a movable carriage (22) carrying a second idle roller (24). The attachment includes belt changing locking means (78) for holding the carriage in a retracted position against the bias of belt tensioning biasing springs (32, 34). A positive belt tracking system (40) is provided for laterally adjusting the carriage relative to longitudinal belt movement around the rollers, to enable proper alignment and positive tracking under differing conditions. A belt tracking tray (70) is mounted to the carriage. A combined guard plate and pressure guide (54) enables guidance and application of sanding pressure by the user in a convenient orientation.

11 Claims, 4 Drawing Figures

BELT SANDER ATTACHMENT FOR A PORTABLE DRILL

BACKGROUND AND SUMMARY

The invention relates to an add-on removable attachment for a hand held portable electric rotary drill or the like, and more particularly to an attachment for adapting the drill to perform as an endless loop belt sander.

The invention initially evolved from efforts to provide a portable belt sander for curved non-planar surfaces, for example in automotive repair work. The invention is usable in numerous other applications, including flat sanding.

The attachment includes a built-in belt changing system facilitating simple and efficient interchanging or replacing of belts. The attachment also incorporates a positive belt tracking system, including adjustable lateral alignment to ensure proper belt tracking under differing conditions. The attachment further includes a guard plate and pressure guide engageable by the user's hand or the like at a particularly ergonometric orientation.

DESCRIPTION OF THE INVENTION

Figure 1:
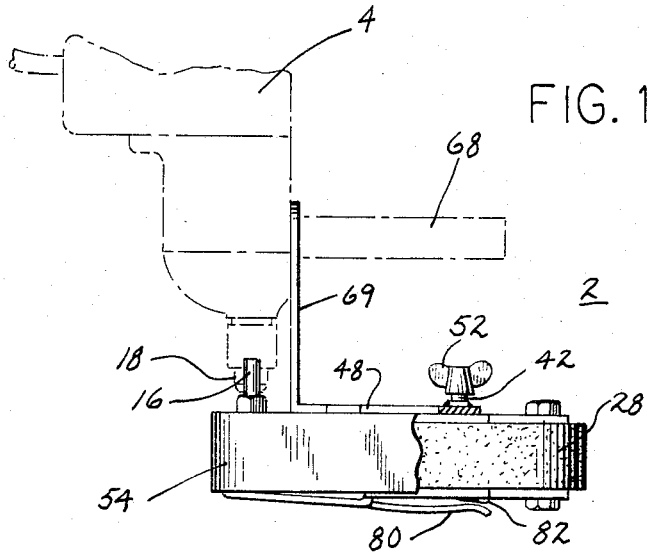
FIG. 1 is a top view of a belt sander attachment in accordance with the invention, with the guard plate and pressure guide partially cut away and with a portable electric drill shown in phantom.

FIG. 1 shows a belt sander attachment 2 for a portable electric drill shown in phantom at 4. The attachment includes a frame 6, FIG. 2, having a drive roller 8 and a first idle roller 10 rotatably mounted to the frame on respective spindles or axles 12 and 14 extending between opposing frame sides 6*a* and 6*b*, FIG. 4. Spindle 12 extends laterally leftwardly through and beyond left frame side 6*b* to form a bit 16, FIGS. 1 and 4, receivable in chuck 18 of drill 4. Lateral reinforcing bar 20, FIG. 4, supports and maintains frame sides 6*a* and 6*b* in proper spaced and rigid relation.

Figure 2:
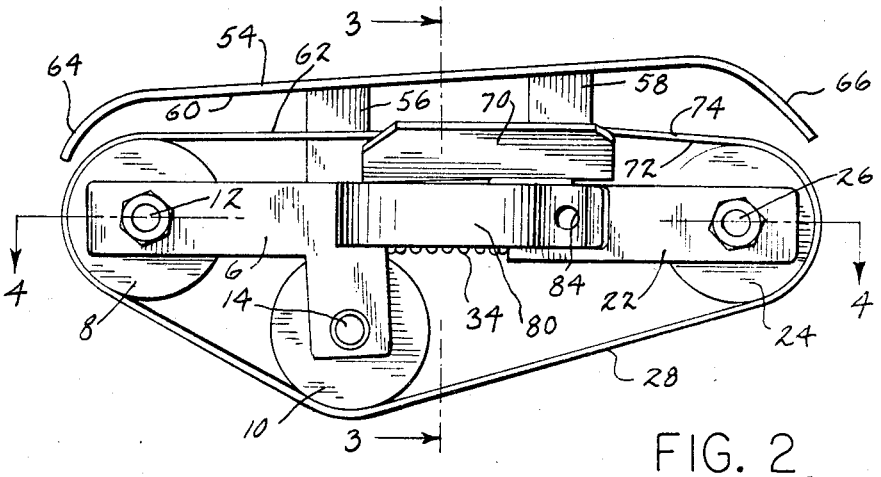
FIG. 2 is a side elevation view of the attachment of FIG. 1.
Figure 4:
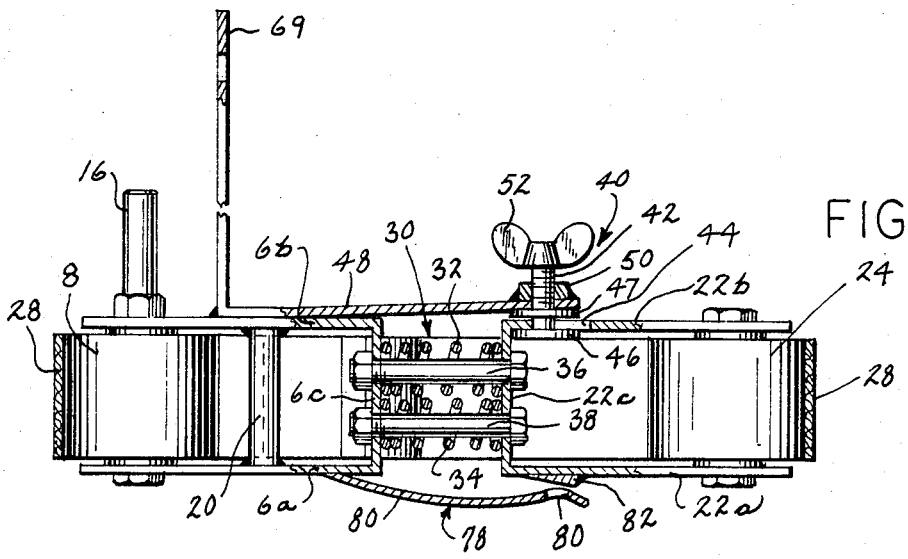
FIG. 4 is a cross sectional view taken along line 4—4 of FIG. 2.

A carriage 22 is movably mounted to the frame for forward-rearward movement (left-right as viewed in FIGS. 2 and 4). Carriage 22 has a second idle roller 24 rotatably mounted thereto by means of spindle or axle 26 extending laterally left-right between carriage sides 22*a* and 22*b*. Rollers 8, 10 and 24 are hard rubber wheels which may be scored or knurled for frictional gripping. The rollers form a triangular configuration for receiving an endless loop sanding belt 28 therearound.

Belt tensioning means are provided by biasing means 30, FIG. 4, bearing between frame 6 and carriage 22, and biasing the carriage rectilinearly forwardly (rightwardly in FIGS. 2 and 4) away from the frame to tension belt 28. As seen in FIG. 4, frame 6 is a rearwardly opening U-shaped member with right and left legs 6*a* and 6*b*. Carriage 22 is a forwardly opening U-shaped member with right and left legs 22*a* and 22*b*. Biasing means 30 comprises a pair of compression springs 32 and 34 bearing between the facing bights 6*c* and 22*c* of the frame and carriage. Springs 32 and 34 coaxially surround respective retaining bolts 36 and 38 secured to bights 6*c* and 22*c*. Springs 32 and 34 lie along the rectilinearly biased path of movement of carriage 22 in the straight line between drive roller 8 and second idle roller 24.

Positive belt tracking means 40 is provided for adjustably moving carriage 22 laterally left-right (up-down in FIGS. 1 and 4; in and out of the page in FIG. 2) relative to longitudinal belt movement around the rollers, to enable proper alignment under differing conditions and ensure tracking of the belt around the rollers. The adjustable positive belt tracking means 40 includes retainer means such as a fastening threaded bolt 42 extending between the frame and carriage and providing user controlled lateral adjustment of the carriage left-right while also permitting forward-rearward movement of the carriage toward and away from frame 6 perpendicularly to the lateral left-right movement of the carriage.

Retainer bolt 42 also provides a stop against carriage movement beyond a limited degree of up-down movement as viewed in FIG. 2 (which is out of an into the page in FIGS. 1 and 4). The up-down movement of carriage 22 is perpendicular to both the noted lateral left-right and the forward-rearward movements of carriage 22 and roller 24. Carriage 22 and roller 24 move upwardly in response to sanding pressure against belt 28, for example as applied between rollers 10 and 24. Belt tracking means 40 includes an elongated slot 44 in left carriage side 22*b* extending forward-rearward, and through which bolt 42 extends. The forward-rearward elongation of slot 44 permits the noted forward-rearward movement of carriage 22. Bolt 42 in slot 44 stops the noted up-down movement of carriage 22 upon engagement with upper or lower edges of the slot.

Bolt 42 has an enlarged right end 46 of diameter greater than the width of slot 44 and engaging the backside of carriage sidewall 22*b*. Bolt 42 has an enlarged washer or the like such as 47 staked thereto or otherwise fixed against axial movement and engaging the other side of carriage sidewall 22*b*. Frame 6 has a forward extension 48 along the left side thereof which overlaps carriage 22 and has a nut 50 soldered thereto through which bolt 42 threadably extends. Bolt 42 is shown with a wing nut 52 at its left end. Upon turning wing nut 52 clockwise, bolt 42 threads through nut 50 which in turn moves washer 47 rightwardly. Washer 47 pushes against carriage sidewall 22*b*, to push carriage 22 laterally rightwardly, and increase the lateral spacing between frame extension 48 and carriage left side 22*b*. Upon turning wing nut 52 counterclockwise, bolt 42 threads out of nut 50 and enlarged bolt end 46 moves leftwardly which in turn pushes against carriage leg 22*b* and moves carriage 22 laterally leftwardly to close the lateral spacing between frame extension 48 and carriage left side 22*b*.

Figure 3:
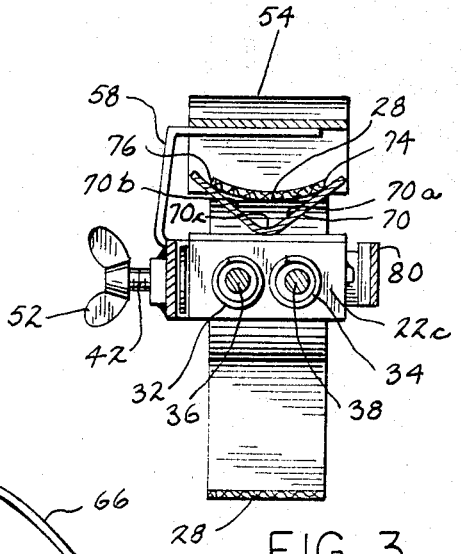
FIG. 3 is a cross sectional view taken along line 3—3 of FIG. 2.

A combined guard plate and pressure guide 54, FIGS. 1–3, is mounted to frame 6 and extends around an edge of belt 28 at C-shaped legs 56 and 58. The guard plate and pressure guide has an inner surface 60 facing an outer sanding surface 62 of belt 28 and spaced outwardly of and above belt 28. Guard plate and pressure guide 54 extends substantially the length of the straight line between drive roller 8 and second idle roller 24 and may be curved at its ends, as at 64 and 66. Guard plate and pressure guide 54 is engageable by a user's hand or the like for guidance and application of downward pressure against a surface to be sanded, for example between rollers 10 and 24 or between rollers 8 and 10. The position of the drill trigger and/or handle guide such as 68 in combination with the placement and orientation of the guard plate and pressure guide is found to be ergonometrically convenient for the user.

A drill mount 69 is attached to frame 6 at a point between drive roller 8 and idle roller 10 and extends laterally leftwardly away from the frame perpendicularly to the plane of the triangle formed by rollers 8, 10 and 24, and parallel to bit 16, for attachment to drill 4, as at handle 68, consistent with the noted relative orientation of drill and guard plate and pressure guide facilitating user convenience.

Compression springs 32 and 34 are spaced inwardly of belt 28 on the opposite side thereof from guard plate and pressure guide 54. First idle roller 10 is on the opposite side of compression springs 32 and 34 from guard plate and pressure guide 54. A belt tracking tray 70 is mounted to one of the frame and carriage. In the disclosed embodiment, tray 70 is mounted to the top side of carriage 22 and engages the inner non-sanding surface 72 of belt 28 for guiding the latter's movement and ensure tracking engagement with the rollers. Tracking tray 70 is a V-shaped member engaging the edges 74 and 76, FIG. 3, of belt 28 along the inner facing V-sides 70*a* and 70*b* and slightly bowing the middle of belt 28 downwardly toward the apex 70*c* of the V.

Attachment 2 includes belt changing means comprising locking means 78 for retaining carriage 22 and roller 24 in a rearwardly retracted position relative to frame 6 and against the bias of springs 32 and 34, to permit changing or replacement of belts. Locking means 78 includes a resiliently self-biased latch on one of the frame and carriage, and a catch on the other. As shown, latch 80 extends forwardly from frame 6 and overlaps the right side of the carriage, and a catch 82 is formed by a detent or soldered protrusion on right carriage side 22*a*. Latch 80 has an aperture 84 therethrough which frictionally engages the forward edge of protrusion 82 upon rearward retraction of the carriage, and is released upon lateral rightward movement of latch 80 and/or lateral leftward movement of carriage 22, for example by counterclockwise rotation of wing nut 52.

It is recognized that various alternatives are possible within the scope of the appended claims.

I claim:

1. A belt sander comprising:

a frame;

a drive roller rotatably mounted to said frame;

an idle roller rotatably mounted to said frame;

a carriage movably mounted to said frame;

a second idle roller rotatably mounted to said carriage, said rollers forming a triangular configuration for receiving an endless loop sanding belt therearound, said rollers being interior of said sanding belt;

belt tensioning means comprising biasing means bearing between said frame and carriage and biasing said carriage rectilinearly away from said frame to tension said belt, said sanding belt having a flexible span between at least two of said rollers, providing a sanding belt which flexes inwardly such that its outer surface curves when applied against curved nonplanar sanding surfaces;

wherein said biasing means comprises compression spring means lying along the rectilinearly biased path of movement of said carriage, and wherein said sanding belt has a first flexible span between said first idle roller and said second idle roller, and a second flexible span between said first idle roller and said drive roller;

wherein said carriage and second idle roller are biased along a straight line between said drive roller and said second idle roller, and said compression spring means lies along said straight line;

and comprising a combined guard plate and pressure guide mounted to said frame and extending around an edge of said belt and having an inner surface facing said outer surface of said belt and spaced outwardly away therefrom and extending substantially the length of said straight line between said drive roller and second idle roller, and having an outer surface engageable by a user's hand or the like for guidance and application of pressure, said combined guard plate and pressure guide applying sanding pressure to each of said spans against respective sanding surfaces.

2. The invention according to claim 1 wherein said compression spring means is spaced inwardly of said belt on the opposite side thereof from said guard plate and pressure guide, and wherein said first idle roller is on the opposite side of said compression spring means from said guard plate and pressure guide, and wherein the length of the span between said first idle roller and said drive roller is fixed and is shorter than the length of the span between said first idle roller and said second idle roller.

3. The invention according to claim 2 comprising a belt tracking tray mounted to one of said carriage and frame between said compression spring means and said guard plate and pressure guide, said tracking tray engaging the inner surface of said belt for guiding the latter's movement and ensure tracking engagement with said rollers.

4. The invention according to claim 3 wherein said tracking tray comprises a V-shaped member engaging the edges of said belt along the inner facing V sides and slightly bowing the middle of said belt toward the apex of the V which is in a direction away from said guard plate and pressure guide and toward said compression spring means and first idle roller.

5. The invention according to claim 2 comprising a drill mount attached to said frame at a point between said drive roller and first idle roller and extending away from said frame perpendicularly to the plane of said triangle formed by said rollers and parallel to the axis of rotation of said drive roller.

6. A belt sander attachment for a portable drill or the like, comprising:

a frame;

roller means rotatably mounted to said frame;

a carriage movably mounted to said frame;

roller means rotatably mounted to said carriage, one of said roller means comprising a drive roller having means receivable in a chuck of a portable drill or the like;

belt tensioning means comprising biasing means biasing said carriage relative to said frame to tension a sanding belt around said roller means; and positive belt tracking means comprising means for adjustably moving said carriage laterally left-right relative to longitudinal belt movement around said roller means to enable proper alignment and ensure belt tracking around said roller means under differing conditions;

wherein said carriage is biased by said biasing means rectilinearly forwardly away from said frame for forward-rearward movement, and wherein said biasing means lies along said forward-rearward path of movement, and wherein said belt tracking means comprises retainer means extending between said frame and carriage and providing user controlled lateral adjustment of said carriage left-right and permitting forward-rearward movement of said carriage toward and away from said frame perpendicularly to said lateral left-right movement;

wherein said retainer means comprises means stopping said carriage beyond a limited degree of up-down movement perpendicular to both said lateral left-right and said forward-rearward movements in response to sanding pressure against the belt.

7. The invention according to claim 6 wherein said belt tracking means comprises an elongated slot in one of said frame and carriage extending forward-rearward, and fastening means on the other of said frame and carriage extending laterally through said slot, the forward-rearward elongation of said slot permitting said forward-rearward movement of said carriage, said fastening means through said slot stopping said up-down movement of said carriage upon engagement with upper or lower edges of said slot.

8. The invention according to claim 7 wherein said fastening means comprises bolt means extending through said slot and having enlarged portions of diameter greater than the width of said slot and engaging sidewalls forming said slot to adjust the lateral spacing of said frame and carriage upon turning of said bolt means.

9. The invention according to claim 7 wherein said first mentioned roller means comprises said drive roller rotatably mounted to said frame and a first idle roller rotatably mounted to said frame, and wherein said second mentioned roller means comprises a second idle roller rotatably mounted to said carriage, said rollers forming a triangular configuration for receiving an endless loop sanding belt therearound.

10. The invention according to claim 9 wherein said belt tracking means further comprises a tracking tray mounted to said carriage and engaging the inner surface of said belt for guiding the latter's movement and ensure tracking engagement with said rollers, said tracking tray comprising an upwardly facing V-shaped member engaging the edges of said belt along the inner facing V sides and slightly bowing the middle of said belt downwardly toward the apex of the V.

11. A belt sander attachment for a portable drill or the like, comprising:

a frame;

a drive roller rotatably mounted to said frame and having means receivable in a chuck of a portable drill or the like;

an idle roller rotatably mounted to said frame;

a carriage movably mounted to said frame;

a second idle roller rotatably mounted to said carriage, said rollers forming a triangular configuration for receiving an endless loop sanding belt therearound, said rollers being interior of said sanding belt;

belt tensioning means comprising biasing means bearing between said frame and carriage and biasing said carriage rectilinearly forwardly away from said frame for forward-rearward movement, said biasing means lying along the rectilinearly biased forward-rearward path of movement of said carriage;

adjustable positive belt tracking means comprising means for laterally moving said carriage left-right relative to said forward-rearward movement of said carriage and relative to longitudinal belt movement around said rollers to enable proper alignment under differing conditions;

belt changing means comprising locking means for retaining said carriage and second idle roller in a retracted rearward position relative to said frame and against the bias of said biasing means to permit changing of belts; and a combined guard plate and pressure guide mounted to said frame and extending around an edge of said belt and having an inner surface facing an outer surface of said belt and spaced outwardly of and above said belt, and having an outer surface engageable by a user's hand or the like for guidance and application of downward pressure;

said sanding belt having a first flexible span between said first idle roller and said second idle roller, and a second flexible span between said first idle roller and said drive roller, wherein each of said spans flexes inwardly such that the outer surface of said sanding belt curves against curved nonplanar sanding surfaces, said combined guard plate and pressure guide applying sanding pressure to each of said spans against respective sanding surfaces.

* * * * *